US006222575B1

(12) United States Patent
Liu et al.

(10) Patent No.: US 6,222,575 B1
(45) Date of Patent: Apr. 24, 2001

(54) HIGH PRECISION DYE DONOR WEB POSITIONING IN THERMAL COLOR PRINTER

(75) Inventors: Shih-mim Liu, Ping-tung Hsien; Shi-pyung Cuo, Hsinchu, both of (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 09/304,467

(22) Filed: May 3, 1999

(30) Foreign Application Priority Data

Feb. 12, 1999 (TW) ..... 88102230

(51) Int. Cl.[7] ..... B41J 33/14
(52) U.S. Cl. ..... 347/217
(58) Field of Search ..... 347/177, 217; 400/246, 238

(56) References Cited

U.S. PATENT DOCUMENTS 5,466,075 * 11/1995 Kouzai et al. ..... 400/240
5,978,005 * 11/1999 Hadley ..... 347/177

* cited by examiner

*Primary Examiner*—N. Le
*Assistant Examiner*—K. Feggins
(74) *Attorney, Agent, or Firm*—W. Wayne Liauh

(57) ABSTRACT

This invention relates to a donor web positioning apparatus and method of a thermal color printer with a thermal print head defining a print line and adapted to thermally transfer colored dye from a dye donor web onto a dye receiver medium. The donor web positioning apparatus of the present invention includes a web drive, a sensing device and a controller. The web drive is adapted to deliver the dye donor web consisting of a plurality of colored dye frames for thermal print. The sensing device generates a digital code according to the light intensity of transmission of light beams through the donor web for identifying the leading edge and color of a frame located at the print line. According to the digital code, the controller controls the motion of the web drive for precisely positioning the dye donor web related to the thermal print head.

12 Claims, 9 Drawing Sheets

| Color of Ribbon | (R')Bright Red (311a) | (R)Weak Red (312a) | (G)Green (313a) |
|---|---|---|---|
| Y | 1 | 1 | 1 |
| M | 1 | 1 | 0 |
| C | 1 | 0 | 0 |
| K | 0 | 0 | 0 |
| O | 1 | 1 | 1 |

FIG. 11

HIGH PRECISION DYE DONOR WEB POSITIONING IN THERMAL COLOR PRINTER

BACKGROUND OF THE INVENTION

The present invention relates to an apparatus and method for positioning a dye donor web in a thermal color printer for minimal waste and cost.

In a color thermal printing process of a thermal color printer, the finished print is made by successively transferring color dyes from respective dye patches of a dye donor web onto a dye receiver medium with a thermal printer head. In general, a dye donor web contains a repeating series of frames of different colored, heat transferable dyes. The color series of a dye donor web can be YMC (yellow, magenta, cyan), YMCK (YMC, black), YMCO (YMC, overlay) or YMCKO. During the color printing process, it is necessary to have the dye donor web properly positioned relative to the dye receiver medium to ensure full coverage of the image area by successive color frames. Since the donor web has a repeating series of different colored dye frames, it is necessary to identify the leading edge of each different frame of each color series. One way to do this is to provide sensor marks on the donor, such as disclosed in U.S. Pat. No. 5,466,075 which inserted different black bars at the leading edges of the colored frames (the yellow frame) of each series as the sensor marks. Another way to identify the frames is to provide color discriminating optical sensors directly located in the donor web path just past the print line of the thermal print head in the direction of travel of the donor web, such as disclosed in U.S. Pat. Nos. 4,710,781 and 5,266,967. These sensors detect the presence of different colored patches on the donor as they move forward. The particular dye frame can be identified by analyzing the light intensity of transmission or reflection of a light beam or a plurality of light beams with different colors. It is noted that the sensor marks and the physical configuration of the print head and surrounding mechanisms indeed limit the minimum size of the color frames. Among the consequences of having unused donor are: a higher cost of material for making prints, reduced donor web capacity in the printer, and a great amount of material requiring environmentally safe disposal after use.

As shown in FIG. 1, the thermal color printer of the prior art comprises a dye donor web 10 having a plurality of dye frames in a repeating series of different colors; a web drive 20 adapted to move and receive the dye donor web 10, which includes a ribbon supply spool 21, a received spool 22, a motor 23 used to rotate the received spool 22, two idle rollers 24, 25 and a platen roller 26; a sensor device 30 adapted between the idle roller 25 and the platen roller 26, which consists of a light source 31 and an optical sensor 32 for identifying the dye frames; and a controller 40 used to position the dye donor web 10 with high precision by properly driving the web drive 20. During the color thermal printing process, the web drive 20 is driven by the controller 40 to deliver the dye donor web 10 adapted on the ribbon supply spool 21 to the received spool 22 through the idle roller 24, the platen roller 26 and the idle roller 25 for taking up the used donor web. At the opposite position of the platen roller 26, there is a thermal print head 50, and a print line 60 is consequently formed between the thermal print head 50 and the platen roller 26. The thermal print head 50 is energized to transfer dye from the donor web at the print line 60 to a receiver medium. In the system shown in FIG. 1, it is desirable to position the sensor device 30 as close as possible to the print line 60 because the amount of the donor web 10 after positioning is not used in printing, and is therefore wasted. Unfortunately, the physical configuration of the print head and surrounding mechanisms indeed limit the minimum distance that can be achieved. This, in sum, limits the minimum size of the color frames. Among the consequences of having unused donor are: a higher cost of material for making prints, reduced printing capacity in the printer, and increased volume of material requiring environmentally safe disposal after use.

In order to minimize the waste of the donor web, an improved configuration of the thermal color printer was disclosed in U.S. Pat. No. 4,710,781 and shown as FIG. 2. A motor 27 linked with the ribbon supply spool 21 is programmed to rotate the ribbon supply spool 21 through a predetermined arc length in the reverse-feed direction to draw the web 10 backward for minimizing the distance between the leading edge of every color frame and the print line 60. However, since the distance of web moving is not only a function of the amount of supply spool rotation, but also a function of supply roll diameter, the amount of rotation of the ribbon supply spool 21 must be determined for a full supply roll. Thus, operation with anything other than a full supply roll still results in additional dye donor web waste. In U.S. Pat. No. 5,549,400, an encoder wheel 28 and an encoder sensor 29 are disposed in the ribbon supply spool 21 for positioning the dye donor web 10 with a high precision control to the rotation angle of the ribbon supply spool 21. This configuration indeed reduces the waste of the web, however increases the cost and assembly complexity of the thermal color printer.

The drawbacks of the thermal color printers of the prior art are listed as follows:

1. In order to ensure full coverage of the image area by successive color frames, the optical sensors directly located in the donor web path just past the print line of the thermal print head in the direction of travel of the donor web. The amount of dye donor web between the sensors and the print line of the thermal print head is unused.

2. In order to identify the color frame, sensor marks are inserted on the donor web. The total length of the donor web is consequently reduced and may result in reducing the capacity of printing.

3. In the configuration of disposing a motor in the supply spool, since the rotation angle of the motor is a function of the spool roll diameter, the operation with anything other than a full supply roll still results in additional dye donor web waste.

4. The cost and assembly complexity of the thermal color printer with additional encode wheel and sensors are obviously increased.

SUMMARY OF THE INVENTION

The objective of the invention is to overcome the problems of dye donor waste, high cost and assembly complexity as set forth above.

According to the present invention, the donor web positioning apparatus of a thermal color printer of the invention includes a dye donor web having a plurality of dye frames in a repeating series of different colors; a web drive adapted to move the dye donor web, which includes: a ribbon supply spool; and a sensing device positioned between the ribbon supply spool and the print line of the printer, which includes at least two colored light sources with the same color and optical sensors. The optical sensors detect the light intensity of transmission of the light beams for identifying the color of the frame through the sensing device, and generates a signal to the web drive for moving and positioning the dye donor web.

BRIEF DESCRIPTION OF THE DRAWINGS

Other objects, features, and advantages of the invention will become apparent from the following detailed description of the preferred but non-limiting embodiments. The description is made with reference to the accompanying drawings in which:

FIG. 11 is a table of the truth values of the colors: Y, M, C, K, 0.

DETAILED DESCRIPTION OF THE PREFERRED EMBODIMENTS

Figure 1:
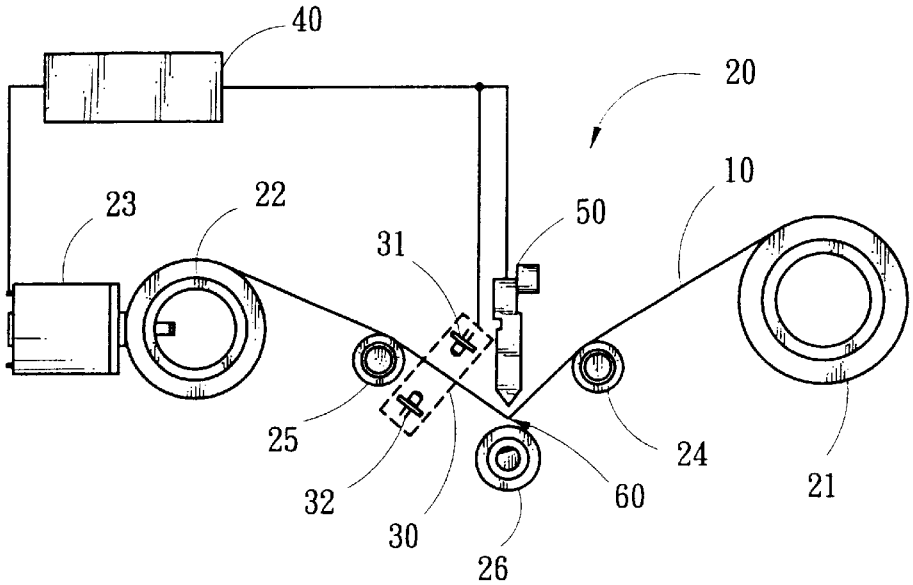
FIG. 1 Prior Art
FIG. 1 shows the first embodiment of the donor web positioning apparatus of a thermal color printer according to the prior art.
Figure 2:
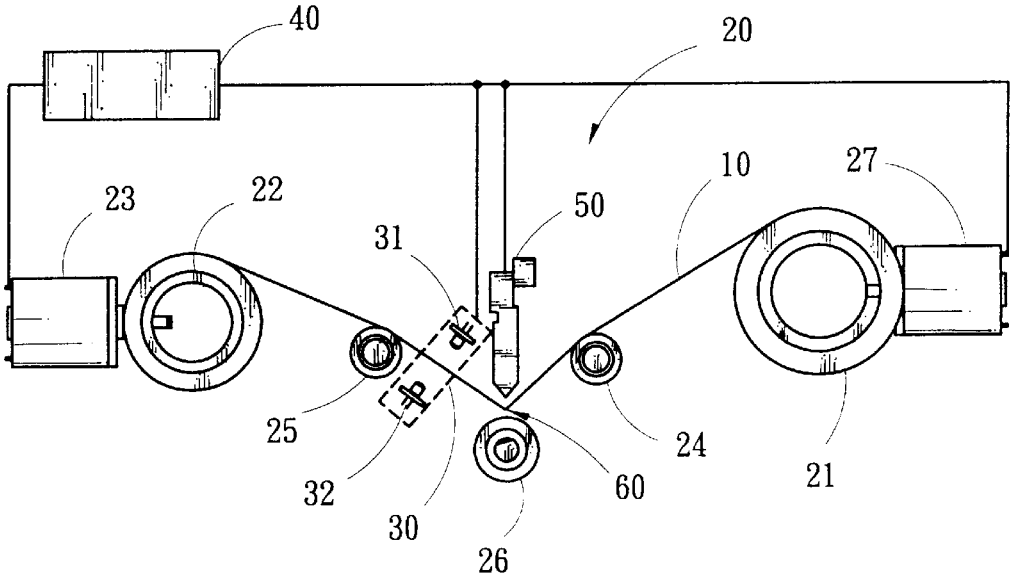
FIG. 2 Prior Art
FIG. 2 shows the second embodiment of the donor web positioning apparatus of the prior art.
Figure 3:
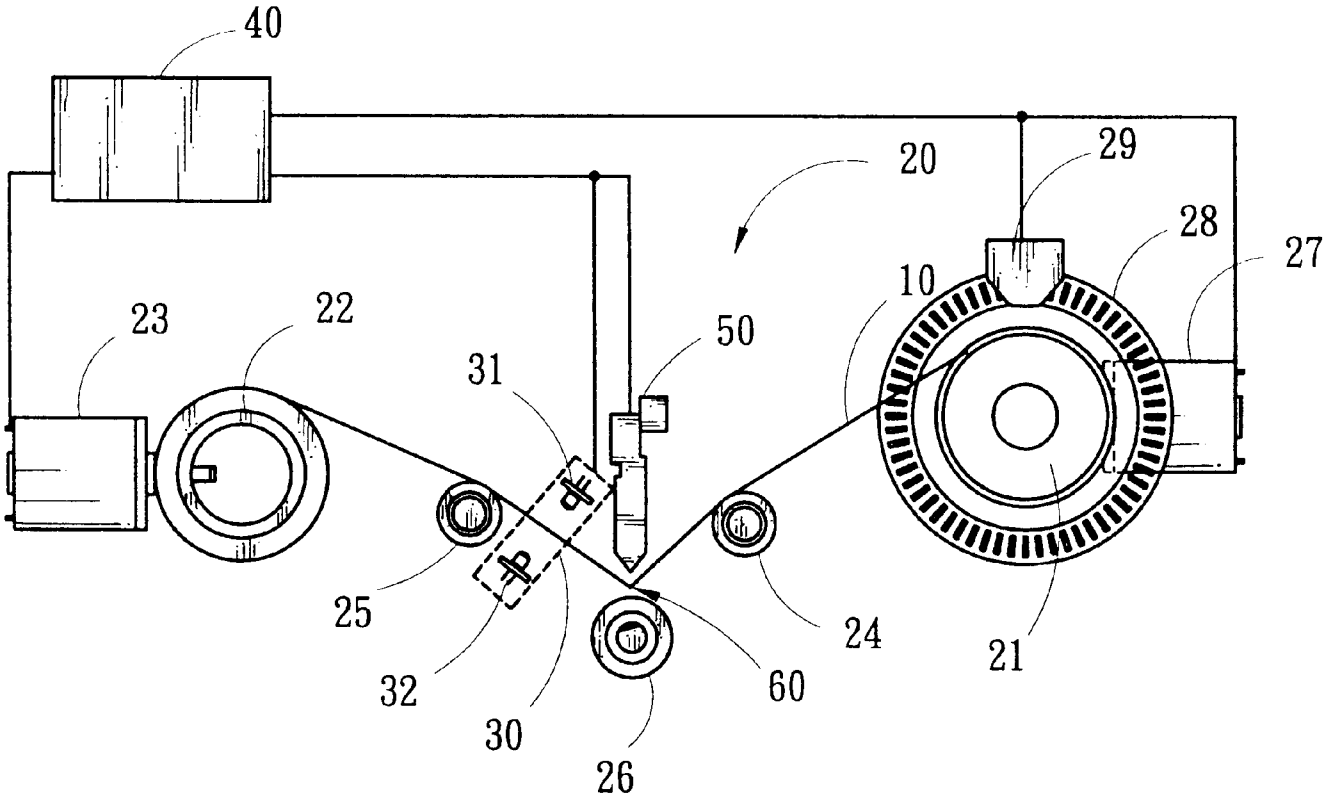
FIG. 3 Prior Art
FIG. 3 shows the third embodiment of the donor web positioning apparatus of the prior art.
Figure 4:
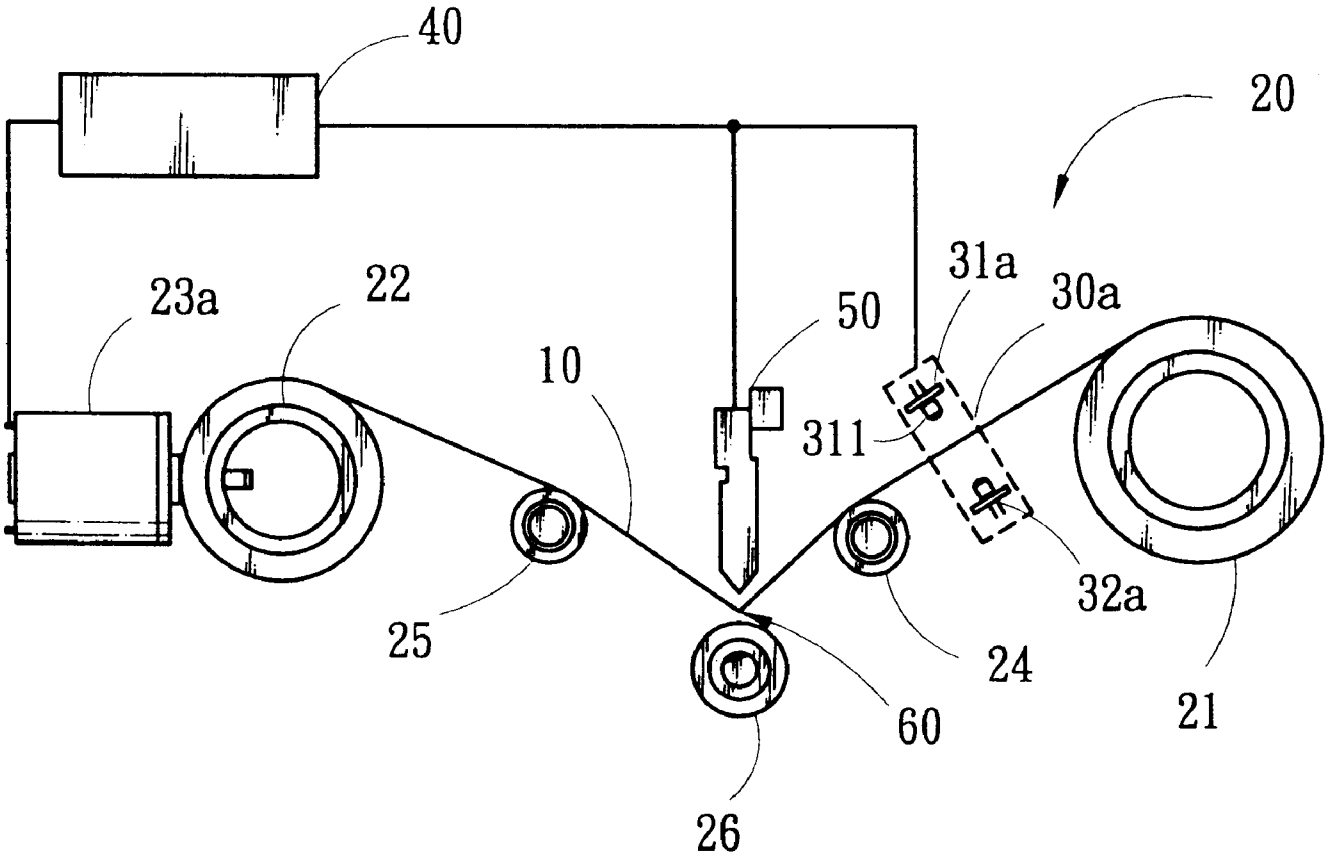
FIG. 4 is a diagrammatic side view of a donor web positioning apparatus of the present invention.
Figure 5:
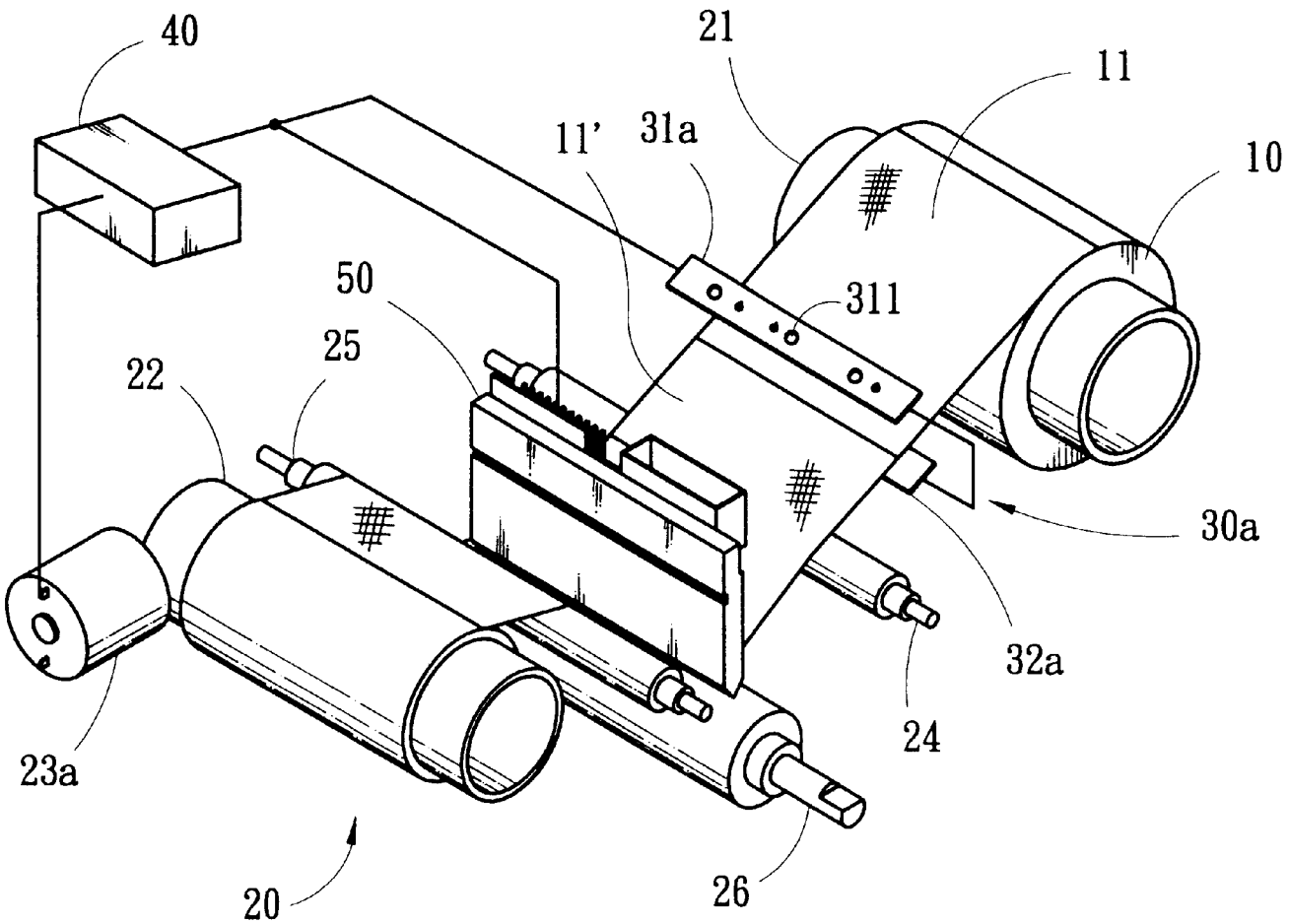
FIG. 5 is a diagram of the donor web positioning apparatus shown in FIG. 4.
Figure 6:
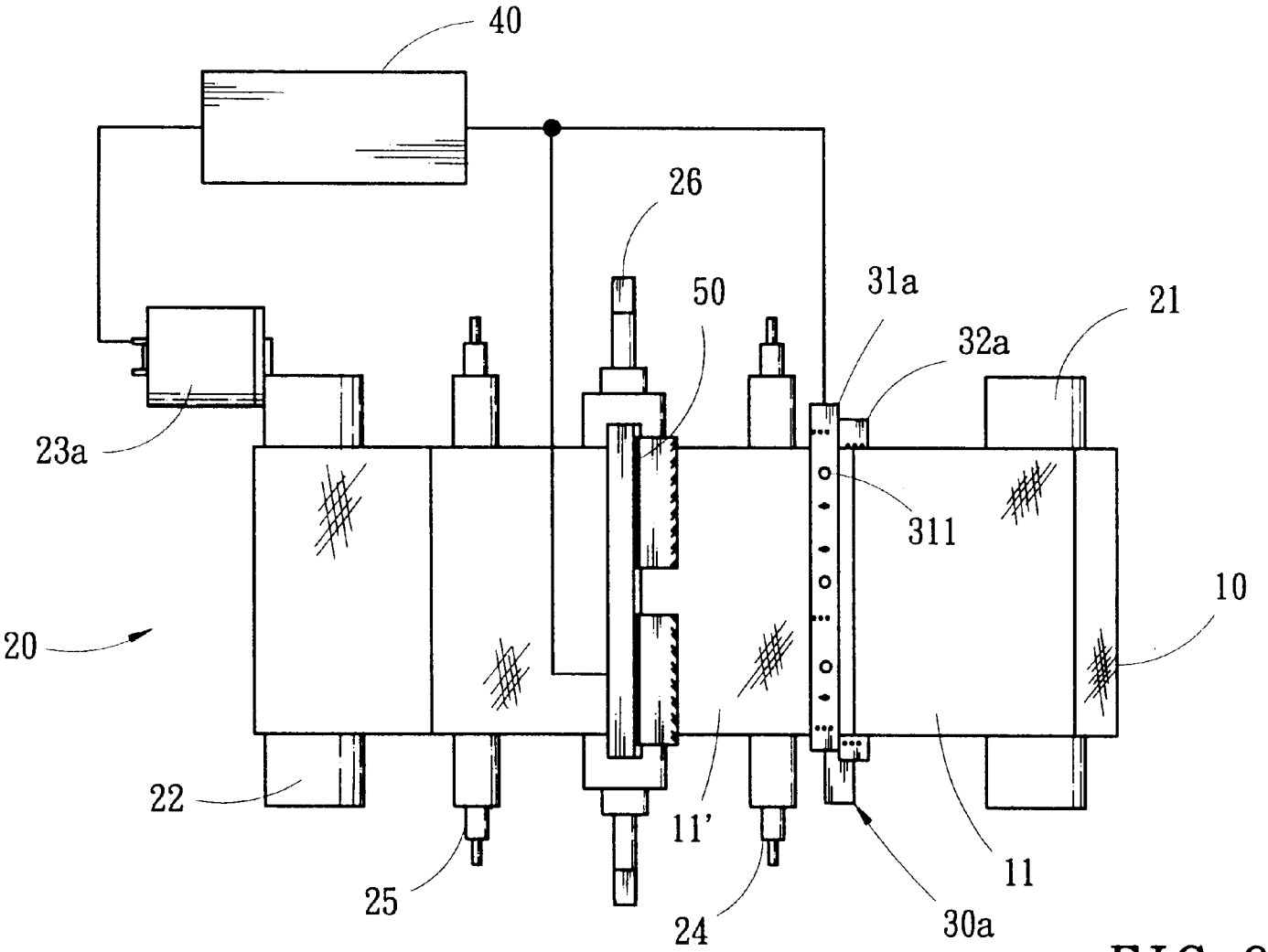
FIG. 6 is a diagrammatic top view of the donor web positioning apparatus shown in FIG. 4.
Figure 7:
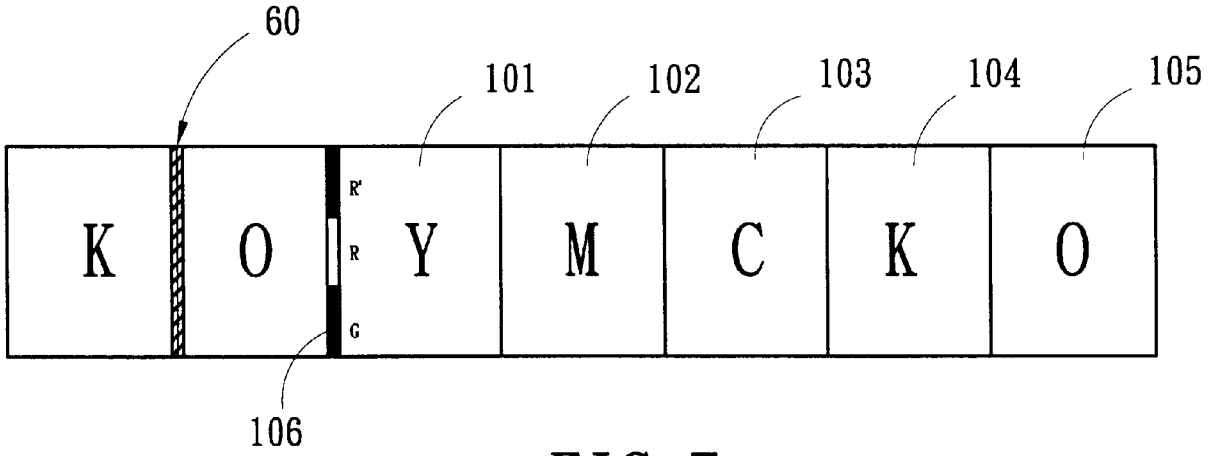
FIG. 7 is the first embodiment of a sensor mark on a dye donor web according to the present invention.
Figure 8:
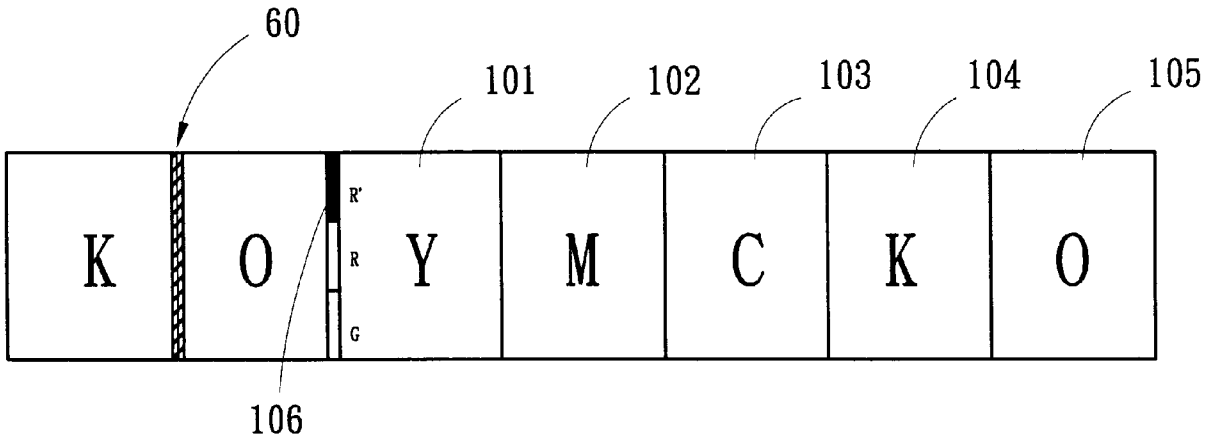
FIG. 8 is the second embodiment of a sensor mark of the present invention.
Figure 9:
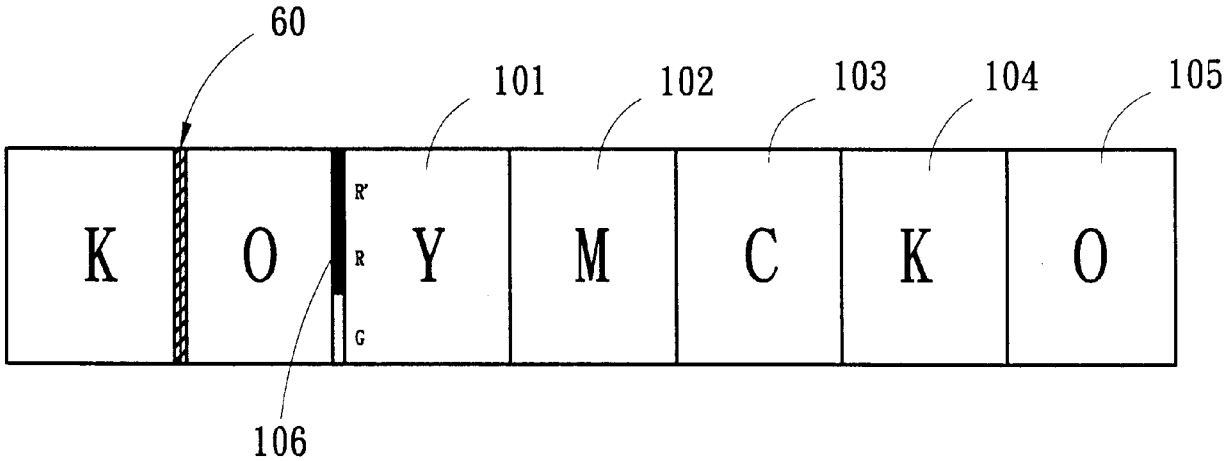
FIG. 9 is the third embodiment of a sensor mark of the present invention.
Figure 10:
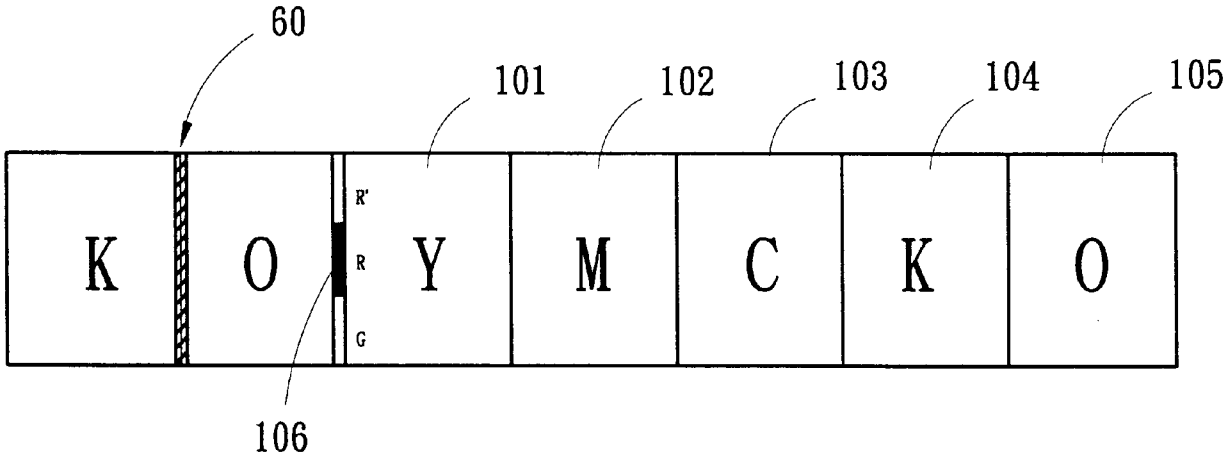
FIG. 10 is the forth embodiment of a sensor mark of the present invention.

A donor web positioning apparatus of the present invention shown in FIGS. 4, 5 and 6 for a thermal color printer comprises a web drive 20 adapted to move a dye donor web 10, which includes a ribbon supply spool 21, a received spool 22, a power generator 23*a* (for example a DC motor) provided to rotate the received spool 22, two idle rollers 24, 25 and a platen roller 26; a sensing device 30*a* disposed between the ribbon supply spool 21 and the platen roller 26, which consists of at least two optical sensors 32*a* and light generators 31 *a* providing light beams 311 of the same color but different light intensity; and a controller 40 provided to judge the color of the frame through the sensing device 30*a* and position the leading edge of a frame of the dye donor web 10 related to the print line 60 with high precision according to the signal delivered from the optical sensors 32*a*. In addition, the dye donor web 10 disposed on the ribbon supply spool 21 consists of a plurality of frames 11 in a repeating series of different colors such as: yellow (Y), magenta (M), cyan (C), black (K) and overlay (O). At the opposite position of the platen roller 26, there is a thermal print head 50. A print line 60 is consequently formed between the thermal print head 50 and the platen roller 26. The light generators 31*a* can be light emission diodes (LEDs).

The operation for positioning the leading edge of a frame of the dye donor web is described as follows. During the color thermal printing process, the web drive 20 controlled by the controller 40 is driven by the power generator 23*a* to deliver the dye donor web 10 to the received spool 22 through the sensing device 30*a*, the idle roller 24, the platen roller 26 and the idle roller 25 for taking up the used donor web. The optical sensing device 30*a* is directly located in the donor web path just the length of a frame 11 preceding the print line 60 in the direction of travel of the donor web 10. Between the optical sensors 32*a* and the light generators 31*a*, there exists a gap which the donor web path goes through. The optical sensors 32*a* faced to the light generators 31*a* are used to detect the light intensity of transmission of light beams 311 through the donor web 10 for identifying the leading edge of a frame. Since the optical sensing device 30*a* is directly located in the donor web path just the length of a frame 11 preceding the print line 60, the leading edge of a frame is located exactly at the print line 60 as the leading edge of a successive frame is located between the sensing device 30*a*. Hence, as yellow dye of a yellow frame is required to be thermally transferred to a dye receiver medium, it is only needed to position the leading edge of the magenta frame successively after the yellow frame. The frame positioning is achieved by the cooperation of the sensing device 30*a*, the controller 40 and the power generator 23*a*. The method for identifying the leading edge of each frame is described below.

The operation for the identification of the color of a frame is described as follows. As the dye donor web 10 is delivered through the sensing device 30*a*, the optical sensors 32*a* detect the light intensity of transmission of light beams 311 through the donor web 10 and generate analog signals for identifying frames colors. These signals are then transformed into digital signals by comparing them with a reference signal. The light beams 311 include a bright red light beam (R') 311*a*, a weak red light beam (R) 312*a* and a green light beam (G) 313*a*. The digital signals for detecting the light intensity of transmission of each light beam through different color frames are listed in the FIG. 11. The digital signals for detecting the transmission light intensity for a yellow frame are the same as those for an overlay frame, i.e. both codes are (111), and the digital signals for detecting the transmission light intensity through the other color frames are different. Hence, in order to distinguish the yellow and overlay frames, a sensor mark is inserted at the leading edge of each yellow or frame of the dye donor web 10. Referring to FIGS. 7 to 10, a sensor mark 106 added at the leading edge of a yellow frame 101 consists of three sections which are transparent or colored (e.g. black). The digital signals for detecting the transmission light intensity through the sensor mark 106 is different from those through the overlay and yellow frame. The digital signals for detecting the sensor marks 106 shown in FIGS. 7 to 10 are (010), (011), (001) and (101), respectively. They are not to be confused with the digital signals of the color frames 101, 102, 103, 104 and 105. Hence, the frames color identification is achieved with the method of the present invention. For example, when the digital signals are changed from (111) to (110), the leading edge of a yellow frame is moved at the print line 60. Similarly, when the digital signals are changed from (110) to (100), the leading edge of a magenta frame is moved at the print line 60. As the digital signals are changed from (111) to any one of the codes (010), (011), (001) or (101), the leading edge of an overlay frame is located at the print line 60. In addition, the leading edge positioning of each frame with high precision is easily achieved by identifying the variance of the digital signals.

Figure 12:
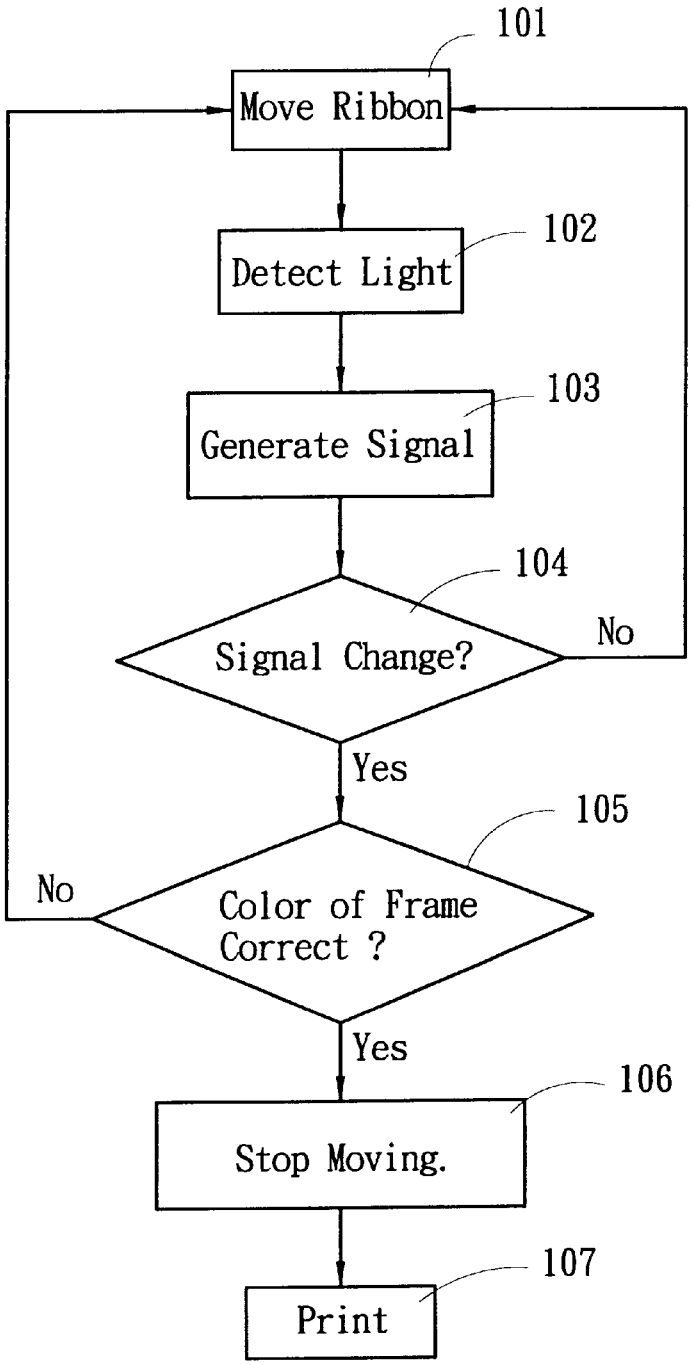
FIG. 12 is a flow chart of a donor web positioning procedure according to the present invention.

Referring to FIG. 12, to sum up, the donor web positioning method of the present invention comprises the following steps:

101. control the web drive 20 to move the dye donor web 10 with the controller 40;

102. detect the light intensity of transmission of the light beams 311 going through the frame 11 into the sensing device 30*a* with the optical sensors 32*a;*

103. generate digital signals according to the detection result in the step 102;

104. check if the digital signals are changed; if YES, go to the next step; otherwise, go to the step 101;

105. check if the desired color of the frame 11 is arrived; if YES, go to the next step; otherwise, go to the step 101;

106. stop moving the dye donor web 10 by controlling the web drive 20 with the controller 40; and

107. thermally print.

With the donor web positioning apparatus and method of the invention, the rewinding motor, encode wheel and encode sensor used in the prior art are not needed without reducing the web positioning precision, and this indeed reduces the cost and assembly complexity of a thermal color printer.

It is noted that the donor web positioning apparatus and method for a thermal color printer described above are the preferred embodiments of the present invention for the purposes of illustration only, and are not intended as a definition of the limits and scope of the invention disclosed. Any modifications and variations that may be apparent to a person skilled in the art are intended to be included within the scope of the present invention.

What is claimed is:

1. A donor web positioning apparatus of a thermal color printer with a thermal print head defining a print line and adapted to thermally transfer colored dye from a dye donor web onto a dye receiver medium, said dye donor web comprising a plurality of color dyed frames and said donor web positioning apparatus comprising:

a web driver adapted to move said dye donor web and including a ribbon supply spool disposing said dye donor web, a platen roller, a received spool and a power generator mounted to said received spool wherein said print line is located between said thermal print head and said platen roller;

a sensing device disposed between said print line and said ribbon supply spool and including at least two optical sensors and corresponding light generators providing a plurality of light beams with the same color, but with different light intensity.

2. The donor web positioning apparatus of a thermal color printer as claimed in claim 1 wherein there exists a sensor mark which is disposed on said dye donor web and located between a yellow dye frame and an overlay dye frame.

3. The donor web positioning apparatus of a thermal color printer as claimed in claim 1 wherein said dye donor web consists of a plurality of dye frames in a repeating series of different colors.

4. The donor web positioning apparatus of a thermal color printer as claimed in claim 1 wherein said light generators are light emission diodes (LEDs).

5. The donor web positioning apparatus of a thermal color printer as claimed in claim 1 wherein said sensing device is adapted to generate a digital code according to the light intensities of transmission of said light beams through said dye donor web for identifying the color of a dye frame located at said print line.

6. The donor web positioning apparatus of a thermal color printer as claimed in claim 5 wherein the dye frame located at said print line and the dye frame located at said sensing device are consecutive.

7. The donor web positioning apparatus of a thermal color printer as claimed in claim 1 wherein said sensing device is disposed about one frame length before said print line.

8. A donor web positioning method of a thermal color printer with a thermal print head, comprising the steps of:

moving a dye donor web containing a plurality of colored dye frames through a donor web positioning apparatus containing a sensing device disposed between a print line and a ribbon supply spool;

generating at least two light beams of the same color but with different intensities to pass through a dye frame;

identifying the color of said dye frame according to a digital code corresponding to signals generated by said light beams, and stopping the movement of said dye donor web by a controller.

9. The donor web positioning method of a thermal color printer as claimed in claim 8 wherein said dye donor web is disposed in a web drive which is used to move said dye donor web through said print line.

10. The donor web positioning method of a thermal color printer as claimed in claim 9 wherein said web drive includes a ribbon supply spool disposing said dye donor web, a platen roller, a received spool and a power generator mounted to said received spool where said print line is located between said ribbon supply spool and said receiver spool and faced to said thermal print head.

11. The donor web positioning method of a thermal color printer as claimed in claim 8 wherein said dye frames are arranged in a repeating series of different colors.

12. The donor web positioning method of a thermal color printer as claimed in claim 8 wherein said sensing device is disposed about one frame length before said print line.

* * * * *